US010355433B2

(12) United States Patent
Lipke et al.

(10) Patent No.: US 10,355,433 B2
(45) **Date of Patent: *Jul. 16, 2019**

(54) LIMITED POWER OUTLET WITH CHANGEABLE PROTECTIVE BEZEL

(71) Applicant: Leviton Manufacturing Co., Inc., Melville, NY (US)

(72) Inventors: Dean S. Lipke, Mill Creek, WA (US); Maurice Zetena, III, New Milford, CT (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/887,719

(22) Filed: Feb. 2, 2018

(65) Prior Publication Data

US 2018/0159272 A1 Jun. 7, 2018

Related U.S. Application Data

(63) Continuation of application No. 15/364,052, filed on Nov. 29, 2016, now Pat. No. 9,912,102.

(51) Int. Cl.
*H01R 24/64* (2011.01)
*H01R 13/645* (2006.01)
(Continued)

(52) U.S. Cl.
CPC ..... *H01R 24/64* (2013.01); *H01R 13/6456* (2013.01); *H01R 13/465* (2013.01); *H01R 2107/00* (2013.01)

(58) Field of Classification Search
CPC .. H01R 24/64; H01R 13/6456; H01R 13/465; H01R 2107/00
(Continued)

(56) References Cited

U.S. PATENT DOCUMENTS 4,332,432 A * 6/1982 Colleran ..... H01R 13/62905 439/157
4,764,129 A * 8/1988 Jones ..... H01R 13/642 439/677
(Continued)

FOREIGN PATENT DOCUMENTS

GB 832658 4/1960
WO 2005029147 3/2005

OTHER PUBLICATIONS

Non-Final Office Action for U.S. Appl. No. 15/364,052 dated May 23, 2017, 21 pages.
(Continued)

*Primary Examiner* — Alexander Gilman
(74) *Attorney, Agent, or Firm* — Amin, Turocy & Watson, LLP

(57) ABSTRACT

A jack receptacle for a plug connector is configured with a receptacle profile having one or more keying features disposed on a removable bezel which correspond to complementary keying features formed on a plug connector. The jack receptacle with removable keyed bezel can be configured to allow only plug connectors with the corresponding keying features to mate therewith, while preventing plugs without the corresponding keying features from mating. These features can prevent non-certified devices from being plugged into a power-delivering data circuit, and also permit the keying of receptacles with removable bezels based on ratings for transmission of different power levels. Other embodiments of the keyed jack receptacle can be configured to allow both plug connectors with the corresponding keying features and plug connectors without the corresponding keying features from mating therewith. This provides a means to migrate specific circuits within the system to limited power usage.

20 Claims, 9 Drawing Sheets

(51) Int. Cl.
*H01R 107/00* (2006.01)
*H01R 13/46* (2006.01)

(58) Field of Classification Search
USPC ..... 439/374
See application file for complete search history.

(56) References Cited

U.S. PATENT DOCUMENTS 4,781,626 A * 11/1988 Lazarchik ..... H01R 13/64 439/680
4,986,769 A * 1/1991 Adams, III ..... H01R 13/64 439/347
5,096,439 A * 3/1992 Arnett ..... H01R 13/741 174/66
5,118,311 A * 6/1992 Margini ..... H01R 13/639 439/676
5,125,852 A * 6/1992 Archer ..... H01R 13/74 439/135
5,356,311 A * 10/1994 Liu ..... H01R 13/518 439/536
5,362,254 A * 11/1994 Siemon ..... G02B 6/3897 439/142
5,647,763 A * 7/1997 Arnold ..... G02B 6/3897 439/532
5,658,166 A * 8/1997 Freeman ..... H01R 13/518 439/49
5,702,271 A * 12/1997 Steinman ..... H01R 24/64 439/676
5,795,186 A 8/1998 Tulley et al.
5,897,395 A * 4/1999 Arnett ..... H01R 13/465 439/491
6,095,844 A * 8/2000 Kasai ..... H01R 13/6271 439/350
6,179,477 B1 * 1/2001 De Marchi ..... G02B 6/3831 385/56
6,186,835 B1 * 2/2001 Cheshire ..... H01R 13/64 439/676
6,312,285 B1 * 11/2001 Berg ..... H01R 13/74 439/545
6,319,070 B1 * 11/2001 Tan ..... H01R 24/64 439/607.43
6,354,884 B1 * 3/2002 Yeh ..... H01R 13/645 439/296
7,131,864 B2 * 11/2006 Peng ..... H01R 31/06 439/536
7,770,035 B1 * 8/2010 John ..... G06F 1/3203 713/300
8,057,249 B1 * 11/2011 Tobey ..... H01R 24/64 439/345
8,222,521 B2 * 7/2012 Kimbrell ..... H01R 13/512 174/66
8,628,351 B2 * 1/2014 Dietz ..... H01R 13/74 439/536
8,708,573 B2 * 4/2014 Gurreri ..... G02B 6/3831 385/58
8,714,994 B2 * 5/2014 Daily ..... H01R 24/64 439/344
8,715,002 B2 * 5/2014 Fitzpatrick ..... H01R 13/6275 439/557
8,858,263 B2 * 10/2014 Afra ..... H01R 13/665 439/620.21
9,106,032 B2 * 8/2015 Chang ..... H01R 27/02
9,337,588 B2 * 5/2016 Chang ..... H01R 13/6594
9,425,560 B1 * 8/2016 Su ..... H01R 13/6591
9,502,840 B2 * 11/2016 Kao ..... H01R 24/60
9,564,716 B2 * 2/2017 Kao ..... H01R 13/6586
9,912,102 B1 * 3/2018 Lipke ..... H01R 13/6456
2004/0161964 A1 * 8/2004 Liebenow ..... H01R 13/64 439/488
2008/0124033 A1 * 5/2008 Gurreri ..... B29D 11/0075 385/78
2014/0065891 A1 * 3/2014 Wang ..... H01R 13/6456 439/681
2014/0094059 A1 * 4/2014 Pepe ..... H01R 13/6658 439/540.1

OTHER PUBLICATIONS

International Search Report for PCT Application No. PCT/US2017/013137, dated May 9, 2017, 5 pages.
Written Opinion for PCT Application No. PCT/US2017/013137, dated May 9, 2017, 5 pages.

* cited by examiner

LIMITED POWER OUTLET WITH CHANGEABLE PROTECTIVE BEZEL

CROSS-REFERENCE TO RELATED APPLICATIONS

This application is a continuation of, and claims priority to, U.S. patent application Ser. No. 15/364,052 (now U.S. Pat. No. 9,912,102), filed on Nov. 29, 2016, and entitled "LIMITED POWER OUTLET WITH CHANGEABLE PROTECTIVE BEZEL," the entirety of which is hereby incorporated herein by reference.

TECHNICAL FIELD

The disclosed subject matter relates generally to data connectors suitable for use with limited power data circuits

BACKGROUND

Many communication and networking circuits, such as in-wall category cable networks, are utilized and certified for the purpose of transmitting low voltage communication signals, often less than 5 volts of direct current (DC) voltage. Some emerging technologies are utilizing such communication circuits and their associated wire and conductors (currently National Electric Code Classification Chapter 7 & 8 class 2 & 3 circuits and communication circuits) to provide power to end (active) devices on such circuits. These types of circuits and their associated connecting hardware are designed and intended for the transmission of both low power—often referred to as "phantom voltage"—and data communication signals.

Since these communication systems were not originally designed or intended to transmit power at these levels, there is no easy way to visually differentiate between a circuit that is being utilized for power and one that is only being used to transmit data signals, particularly in cases in which an existing data-only circuit has been modified to additionally deliver power at levels higher than the phantom voltage. Moreover, inadvertently plugging a non-certified device into a jack for a circuit that provides power as well as transmits data signaling creates a risk of an overvoltage event, such as fire, shock, or damage to the device.

The above-described deficiencies of communication connector systems are merely intended to provide an overview of some of the problems of current technology, and are not intended to be exhaustive. Other problems with the state of the art, and corresponding benefits of some of the various non-limiting embodiments described herein, may become further apparent upon review of the following detailed description.

SUMMARY

The following presents a simplified summary of the disclosed subject matter in order to provide a basic understanding of some aspects of the various embodiments. This summary is not an extensive overview of the various embodiments. It is intended neither to identify key or critical elements of the various embodiments nor to delineate the scope of the various embodiments. Its sole purpose is to present some concepts of the disclosure in a streamlined form as a prelude to the more detailed description that is presented later.

Various embodiments described herein relate to a telecommunications jack and plug system that facilitates traditional data communication and telecom applications, and which is also suitable for use in limited power circuits. In some embodiments, a jack receptacle assembly includes a migratable or changeable mating interface having a keyed profile that is designed to mate with corresponding keyed plugs having a complementary profile. In some embodiments, the keyed profile of the jack can allow only certified equipment (e.g. equipment certified to a specific power threshold), interface cables, and associated patch cables outfitted with the corresponding plug type to mate therewith, making the jacks suitable for connectivity within a limited power circuit. This allows for the development of a backward compatible limited power certified end-to-end system that can be utilized for traditional data communications and telecom applications, and which provides a means to migrate specific circuits within the system to limited power usage. Aspects of the jack and plug systems described herein can allow this migration to take place in a non-disruptive manner, potentially improving return on investment. Protective aspects afforded by the designs described herein can also potentially extend product life cycle to meet or exceed applicable performance, as stated within published safety codes such as the National Electric Code (NEC), for use in a limited power circuit.

To the accomplishment of the foregoing and related ends, the disclosed subject matter, then, comprises one or more of the features hereinafter more fully described. The following description and the annexed drawings set forth in detail certain illustrative aspects of the subject matter. However, these aspects are indicative of but a few of the various ways in which the principles of the subject matter can be employed. Other aspects, advantages, and novel features of the disclosed subject matter will become apparent from the following detailed description when considered in conjunction with the drawings. It will also be appreciated that the detailed description may include additional or alternative embodiments beyond those described in this summary.

DETAILED DESCRIPTION

Figure 1:
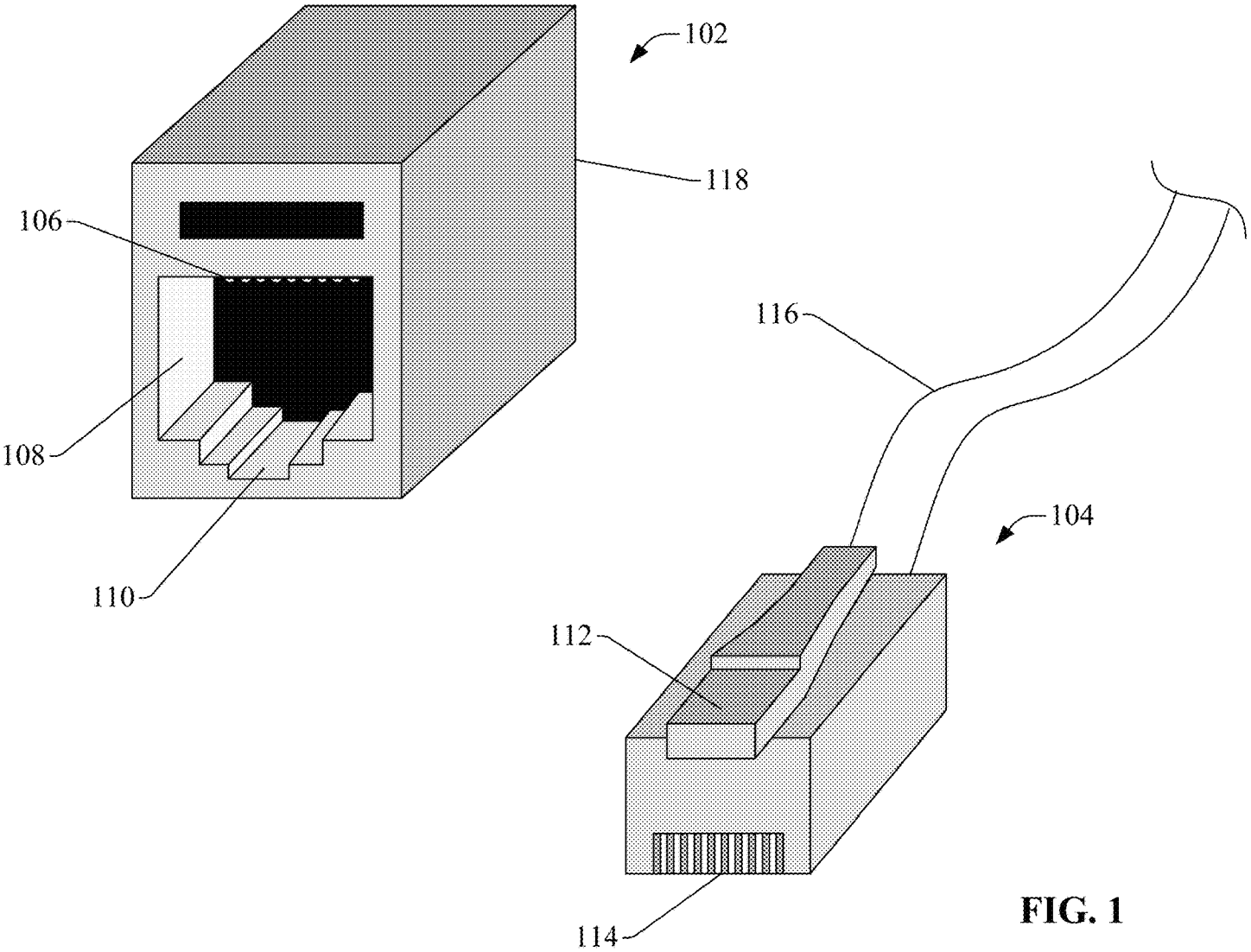
FIG. 1 is a three-dimensional view of an example RJ45 jack receptacle and corresponding plug connector.

The subject disclosure is now described with reference to the drawings wherein like reference numerals are used to refer to like elements throughout. In the following description, for purposes of explanation, numerous specific details are set forth in order to provide a thorough understanding of the subject disclosure. It may be evident, however, that the subject disclosure may be practiced without these specific details. In other instances, well-known structures and devices are shown in block diagram form in order to facilitate describing the subject disclosure.

Although the example jack and plug systems for limited power outlets are described herein in connection with Registered Jack 45 (RJ45) jacks and plugs for explanatory purposes, it is to be appreciated that the concepts described herein are not limited to such RJ45 systems. Rather, features of the changeable bezel described herein are suitable for use with substantially any other type of data communication jack and plug standard, including but not limited to Giga-Gate 45 (GG45), Augmented Registered Jack 45 (ARJ45) or other ARJ systems, TERA, or other such connector types.

FIG. 1 is a three-dimensional view of an example RJ45 jack receptacle 102 and corresponding plug connector 104. Jack receptacle 102 includes a front opening 108 designed to receive corresponding RJ45 plug connector 104. The front opening 108 has a profile that corresponds to that of plug connector 104 so that plug connector 104 properly mates with the front opening. Plug connector 104 includes a spring-loaded latch 112 on an outside surface, which is configured to slide into groove 110 on the bottom inside surface of front opening 108 when the plug connector 104 is inserted into the front opening 108. When the plug connector 104 is fully inserted into the adapter's front opening 108, the latch 112 engages with a corresponding latching feature inside the jack receptacle 102, thereby latching the plug connector 104 inside the jack receptacle 102. The plug connector can be removed from the jack receptacle 102 by applying pressure to the latch 112, thereby disengaging the latch 112 from the corresponding latching feature and allowing the plug connector 104 to be removed. An array of conductive signal contacts 106 or tines installed inside the jack receptacle 102 are configured to maintain electrical contact with corresponding signal contacts 114 on the plug connector 104. Some versions of the plug connector 104 can be terminated to the end of a cable 116 (e.g., a twisted pair category cable). In such scenarios, plug connector 104 can receive cable 116 via a rear side 118 of the plug connector 104. Individual conductors of the cable 116 can be broken out and electrically connected to the signal contacts 114 inside plug connector 104 using any suitable termination system (e.g., insulation displacement connector (IDC) termination, or another conductor termination method). In this way, when the plug connector 104 is inserted into jack receptacle 102, the contacts 106 inside the adapter are electrically connected to corresponding conductors of cable 116. The signal contacts 106 may be connected to corresponding conductors of a communication circuit (e.g., another category cable) via the rear side 118 of the jack receptacle 102. Thus, the connector system comprising the jack receptacle 102 and plug connector 104 provide a means to interface the cable 116 and an associated device (not shown) connected to the opposite end of the cable 116 to the communication circuit connected to the jack receptacle 102.

Jack receptacle 102 may be, for example, a wall mounted jack receptacle 102 installed on a wall plate mounted to a wall. In this configuration, the rear side 118 of jack receptacle 102 may be connected to a cable that runs inside the wall and that connects the jack receptacle 102 to a remote device (e.g., a computer, a server, a multimedia device, etc.) or a network architecture device (e.g., a router, a hub, a switch, etc.). In another installation scenario, jack receptacle 102 may be terminated to a cable located in a plenum space in the ceiling or floor of a building, such that the jack receptacle 102 resides fully inside the wall without being mounted to the wall. In this scenario, the jack receptacle 102 and plug connector 104 can be used to connect two cables that run inside the wall.

Other versions of jack receptacle 102 may be configured to mount to a circuit board rather than being configured to terminate a category cable. In such embodiments, the rear side 118 of the jack receptacle 102 may be configured to interface conductors on the circuit board such that the signal conductors 106 electrically interface with the conductors. In such scenarios, plugging the plug connector 104 into the jack receptacle 102 causes the conductors of cable 116 to be interfaced with the conductors on the circuit board via the signal contacts 106.

Until relatively recently, data communication circuits such as those that employ RJ45 connectors (or other types of connectors) have been designed and rated solely for low voltage communication. However, some emerging technologies utilize such communication circuits and their associated wires and conductors to also provide power to end (active) devices. These types of circuits and associated connecting hardware are designed and intended for the transmission of low power "phantom" voltage as well as data communication circuits. Some current systems that utilize powering technologies such as Power-over-Ethernet (PoE) are limited to 15 watts (W). PoE+ systems are limited to 30 W. Some emerging technologies, such as PoE++ and other technologies, have the capability of presenting power ratings of up to 200 W, and possibly more.

There may be an emerging trend to replace systems that have traditionally relied upon higher voltage AC power with low voltage power systems. Pursuant to this trend, traditional data communication components, such as twisted pair cabling, RJ45 jacks and 8-position plugs (such as jack receptacle 102 and plug connector 104) may form the basis of these systems from the physical perspective. In addition to the transmission of power, these same circuits will be used to simultaneously transmit communication signals. Areas of usage may include, for example, computer connectivity, room and building lighting, remote cameras, access card readers, patient monitoring systems, building automation systems, wireless access points, and other such applications. In such applications, communication circuits (including the cabling and connection hardware) will be used to both exchange data with and provide power to active end devices plugged into the circuit. Consequently, the connectivity platforms implemented for this new power technology will also have the ability to mate with commonly available communications equipment interfaces, such as traditional RJ45 connectors, which may not be adequately rated for the new power levels.

National Fire and Protection Agency (NFPA) 70 (2017 National Electric Code (NEC)) dictates guidelines for component choice as well as installation practices for various types of data and power delivery applications. Recommended installation practices may vary depending on the desired power level, regardless of component choice (e.g., a given component choice may be used with different power levels depending on the installation specifics, such as the size of the cable bundles). While NFPA 70 (2017 NEC) addresses the issue of utilizing communication cabling (e.g., twisted-pair based cabling) and their conductors as a power transmission medium, the issue of future utilization of currently installed data cabling for limited power transmission is not adequately addressed. Nor does NFPA 70 address issues that may arise as a result of increasing power level usage in a currently installed data communication circuit, such as defining controls that limit what power level may be used on different types of cable.

Currently, there is no generally accepted method for differentiating or identifying a system-wide communications circuit that is also acting as a power network. The ability to differentiate between "communication only" circuits and circuits over which power is also being delivered is important since inadvertently plugging a non-certified device into a jack for a circuit that provides power as well as transmits data signaling creates a risk of an overvoltage event, such as fire, shock, or damage to the device.

To address these and other issues, one or more embodiments described herein provide a jack and plug system having a modified matching jack and plug profile, whereby one or more keying features are added to the profile of the front opening of the jack receptacle, and corresponding keying features are added to the plug connector. Jack receptacles having the modified profile can be installed in circuits on which low voltage power is being delivered in addition to communication signals. The modified profile serves to visually identify a jack receptacle as being connected to a power-providing communication circuit. Moreover, some embodiments of the keyed jack receptacle profile prevent plugs or other communication interfaces having the traditional profile (e.g., traditional RJ45, which may not be rated for higher power levels) from being inadvertently plugged into (and interfaced with) the power-delivering communication circuit, thereby mitigating the risk of overvoltage events. In other embodiments, the keyed jack receptacle profile can allow both correspondingly keyed and non-keyed (standard) plug connectors to mate therewith, and can thereby be incorporated as part of a strategy for migrating from a data-only system to a powered data system. In these later embodiments, the keyed plug connectors will be prevented from being plugged into jack receptacles that do not have the corresponding keying feature.

Figure 2:
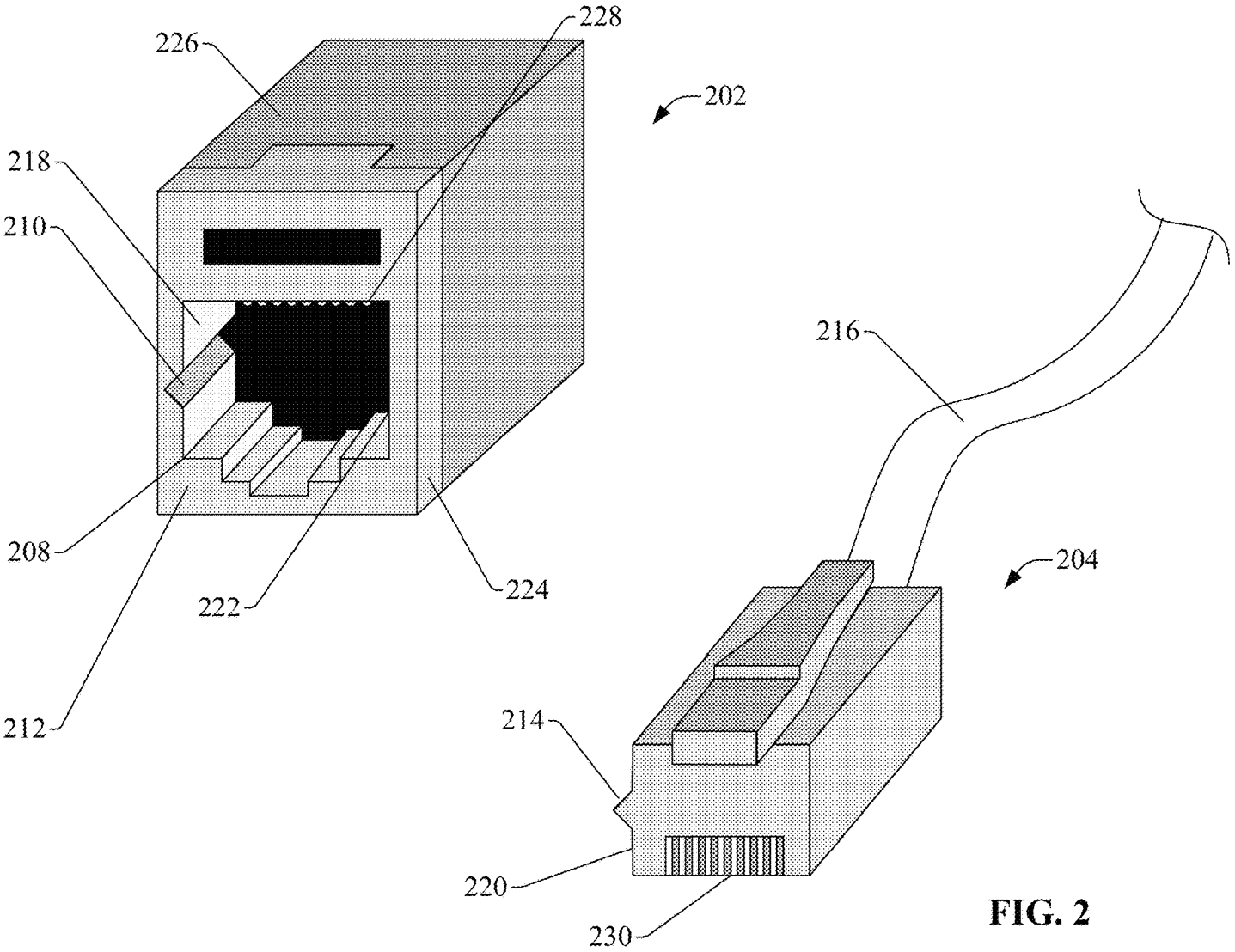
FIG. 2 is a three-dimensional view of an example RJ45 jack receptacle and corresponding plug connector having modified profiles that include a keying feature.

FIG. 2 is a three-dimensional view of an example RJ45 jack receptacle 202 and corresponding plug connector 204 having modified profiles according to one or more embodiments. Similar to jack receptacle 102, jack receptacle 202 has a front opening 208 on a front face 212 of the receptacle 202, which is configured to receive plug connector 204. Signal contacts 228 are mounted inside the jack receptacle 202 and are configured to make electrical contact with corresponding signal contacts 230 on the plug connector 204 when plug connector 204 is fully engaged with the jack receptacle 202.

In this example embodiment, the front opening 208 of jack receptacle 202 differs from the profile of a traditional RJ45 jack by inclusion of a keying feature, which in this illustrated example is a concave V-shaped groove 210 that runs along an interior sidewall 218 of the front opening 208. The groove begins at the front edge of sidewall 218—flush with the front face 212 of the jack receptacle 202—and extends rearward along the sidewall 218 a selected distance. Plug connector 204 has a corresponding convex V-shaped protrusion 214 along a side surface 220. The V-shaped protrusion 214 has a similar profile to that of V-shaped groove 210. As such, the V-shaped groove 210 receives the corresponding V-shaped protrusion 214 on the plug connector 204 when the plug connector 204 is inserted into the jack receptacle 202. The V-shaped protrusion 214 on plug connector 204 prevents the plug connector 204 from being inserted into a traditional RJ45 jack (e.g., jack receptacle 102). V-shaped protrusion 214 and V-shaped groove 210 are keying features that serve to visually distinguish the jack receptacle 202 and plug connector 204 from traditional jacks and plugs, as well as preventing the plug from mating with standard jacks that do not have the corresponding keying feature (in this case, V-shaped groove 210).

Although FIG. 2 depicts the keying features of jack receptacle 202 and plug connector 204 as being a V-shaped protrusion and corresponding V-shaped groove, it is to be appreciated that keying features of other shapes can be used without departing form the scope of one or more embodiments of this disclosure. Other example profile modifications will be described below.

The modified jack receptacle 202 and plug connector 204 are engineered to the meet the required electrical performance of the targeted circuit power usage. As such, when a certified (power rated) patch cord 216 is outfitted with modified plug connector 204, the plug connector 204 would require a similarly certified jack receptacle 202 (modified with V-shaped groove 210) in order to mate by virtue of the convex keying feature (the V-shaped protrusion 214). Conversely, if the modified jack receptacle 202 is installed on a circuit that is not powered, an industry standard (non-power-certified) patch cable with a traditional RJ45 plug (without V-shaped protrusion 214) could be mated to the modified jack receptacle 202, since the keying feature (the V-shaped groove 210) on the jack receptacle 202 is concave.

Unlike traditional AC power circuits, the emerging technologies that deliver both communication signals and power represent a fluid environment whereby a communication system (e.g., an in-wall network) may be initially installed and utilized only for data communication (without power), and subsequently transitioned at a future time to use as a power-delivering data communication system. In some installation scenarios, a system rated for both data and power delivery may be installed, but may initially only be used for data communication. In these scenarios, traditional (non-power certified) components such as patch cords may initially be used with these systems due to cost and availability. Since the modified jack receptacle 202 depicted in FIG. 2 can receive both a modified plug connector 204 or an industry standard (unmodified) plug, the modified jack receptacle 202 facilitates backward compatibility when the data-only circuit is converted to a powered circuit. For example, while the communication circuit is still being used only for data communication, non-power certified components outfitted with traditional RJ45 plugs can be used with the modified jack receptacle 202. When the circuit is eventually used to deliver power as well as data, the power certified plug (e.g., plug connector 204 with modified profile) can be utilized to mate with the power certified modified jack receptacle 202. Thus, the modified jack and plug system depicted in FIG. 2 (or a similarly modified jack and plug having a differently shaped profile modification) provides a means to migrate to the new power certified system. This adaptive ability both protects from overcurrent use as well as extends the lifecycle of the communication infrastructure lifecycle.

In the event that an attempt is made to insert a power-certified modified plug (e.g., plug connector 204 with V-shaped protrusion 214 or another keying feature) into a non-power-certified jack (e.g., a traditional data communications rated jack), the convex V-shaped protrusion 214 (or other suitable profile characteristic) on the side 220 of the plug connector 204 would prevent the mating of the plug connector 204 and jack receptacle, thereby offering protection from possible overvoltage event on a non-power certified circuit. Such overvoltage events may otherwise cause shock, arcing, or fire.

Various embodiments of modified jack receptacle 202 and plug connector 204 can be provided with different mounting options that allow for different environments and usages. For example, in addition to versions that can be affixed to the ends of cables, some embodiments of the modified jack receptacle 202 and corresponding plug connector 204 can be configured to mount on a circuit board (e.g., for use by original equipment manufacturers).

In other variations, the modified jack receptacle 202 and plug connector 204 can be color-coded to allow the certified product power rating of the associated circuit to be readily identified. In an example non-limiting color-coding, red, green, and blue jack receptacles can correspond to circuit power ratings of 15 W, 30 W, and 60 W, respectively. In some scenarios, these color codes can be selected to match the color of the jacket sheathing of the patch cords designated for the respective power ratings to simplify correct component choice.

In some embodiments, the color-coded power ratings can be enforced by modifying the location of the keying feature across the different color-coded jack-plug systems. For example, a red 15 W jack receptacle 202 may be configured such that its V-shaped groove 210 is located higher or lower on the sidewall 218 (or on the opposite sidewall 222) relative to that of a green 30 W jack. Corresponding modifications to the V-shaped protrusion 214 on plug connector 204 for the respective colors would ensure that each type of plug connector 204 would only be able to plug into a similarly colored jack receptacle 202.

Figure 3:
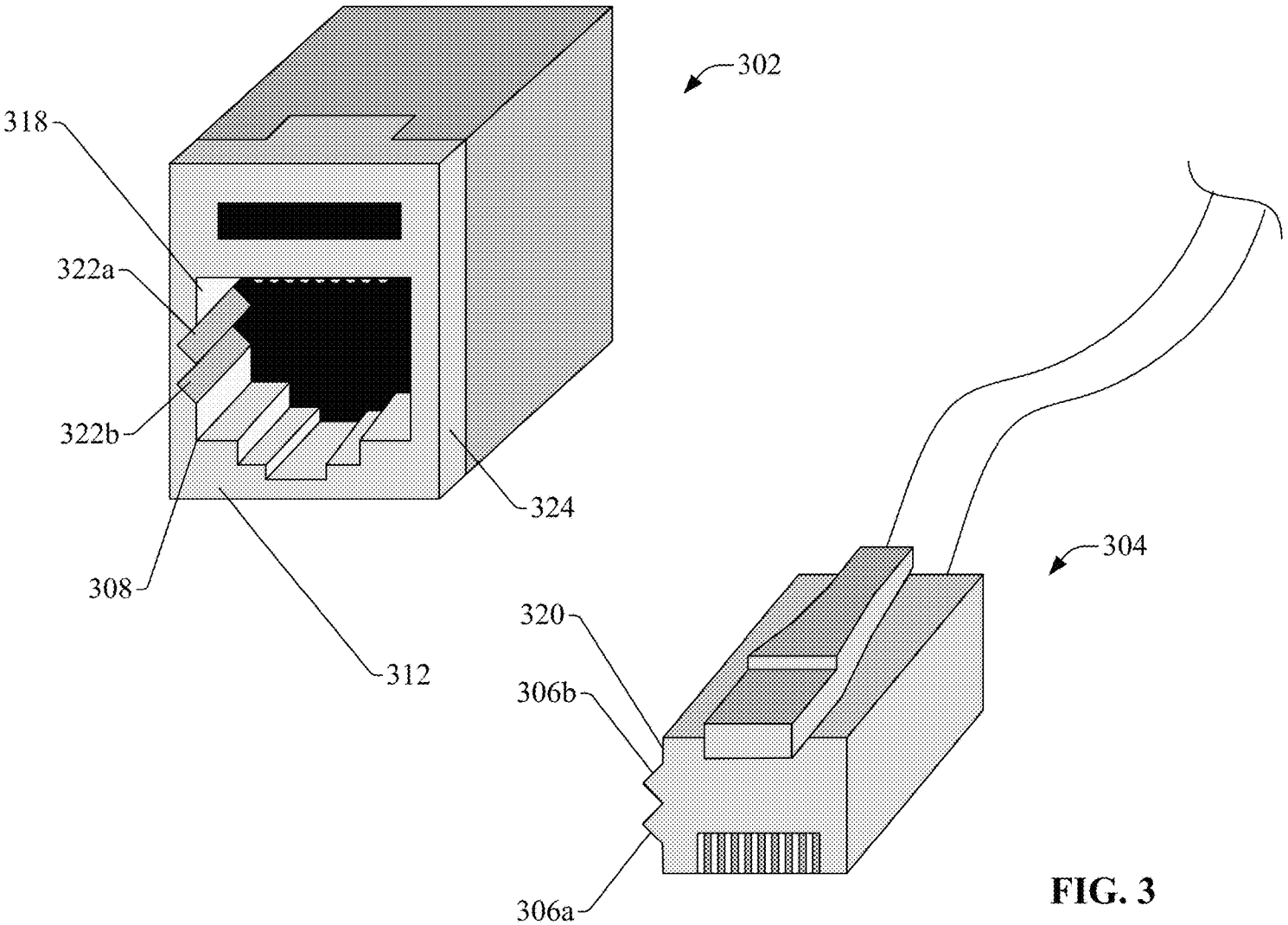
FIG. 3 is a three-dimensional view of an example modified jack receptacle and corresponding plug connector having modified profiles that include two keying features.

In some embodiments, the number of keying features (e.g., V-shaped grooves 210 and protrusions 214) can vary across the different color-coded jacks and plugs. For example, FIG. 3 is a three-dimensional view of an example modified jack receptacle 302 and corresponding plug connector 304 having modified profiles that differ from those of jack receptacle 202 and plug connector 204. In this example, jack receptacle 302 includes two V-shaped grooves 322*a* and 322*b* on sidewall 318, while plug connector 304 has two corresponding V-shaped protrusions 306*a* and 306*b* on side surface 320. In an example embodiment, a red 15 W jack may be configured with a single V-shaped groove, as shown in FIG. 2, while a green 30 W jack may include two V-shaped grooves as shown in FIG. 3. Another jack-plug pair corresponding to another power rating—e.g., a blue 60 W pair—may include a third V-shaped protrusion and corresponding groove, either on the same surfaces as the other two protrusions and grooves or on an opposing surface.

Embodiments that combine color-coding and physical profile variation facilitate easy identification of the power rating of a given circuit, as well as providing physical protection by ensuring that a modified plug can only be inserted into a corresponding jack of similar color-coded type.

Figure 4:
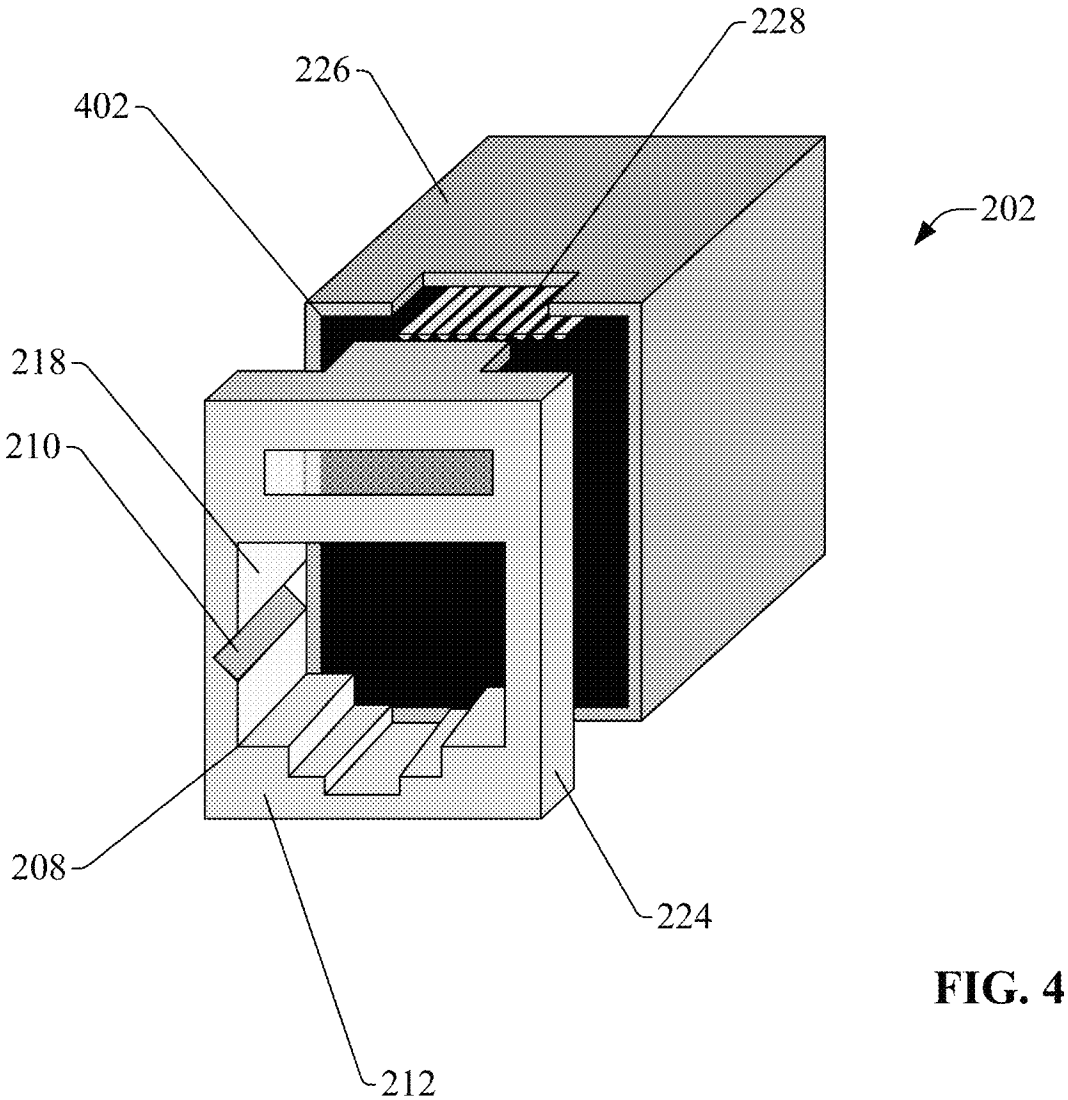
FIG. 4 is a three-dimensional view of a modified jack receptacle showing the receptacle's jack face bezel removed from the jack receptacle housing.
Figure 5:
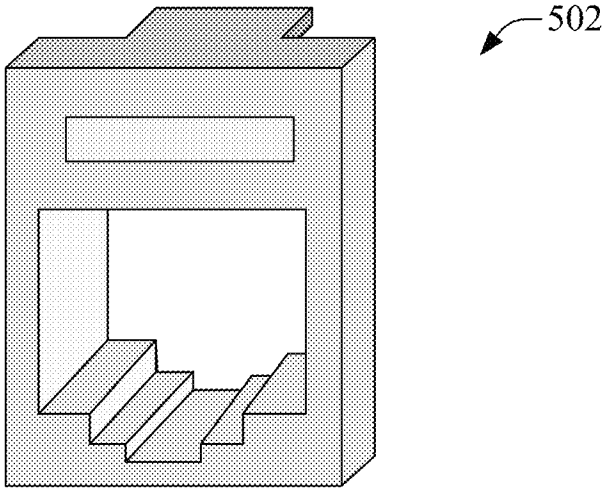
FIG. 5 is a three-dimensional view of a removable bezel having a standard RJ45 receptacle profile.

While in some embodiments the front face 212 of the modified jack receptacle 202 (and likewise front surface 312 of modified jack receptacle 302) may be formed as a continuous portion of the rest of the jack housing, in some embodiments the front face (e.g., front face 212 or 312) and front opening (e.g., front opening 208 or 308) can be formed on a removable and changeable jack face bezel 224 or 324 configured to attached to the front side of the jack receptacle housing. FIG. 4 is a three-dimensional view of modified jack receptacle 202 showing the jack face bezel 224 removed from the jack receptacle housing 226. In this embodiment, the jack receptacle 202 comprises the jack receptacle housing 226, within which are installed the signal contacts 228. The front side 402 of the receptacle housing 226 is open, exposing the interior of the jack receptacle housing 226. The jack face bezel 224 can be attached to and removed from the front side 402 of receptacle housing 226. Configuring the jack face bezel 224 to be removable from the jack receptacle housing 226 allows the profile of the front opening 208 to be modified as needed. For example, jack face bezel 224 may be removed and replaced with jack face bezel 324 (see FIG. 3) on the jack receptacle housing 226 to facilitate changing the jack receptacle 202 from a 15 W jack to a 30 W jack. A removable bezel for a standard RJ45 profile can also be provided. FIG. 5 is a three-dimensional view of a removable jack face bezel 502 having a standard RJ45 profile. Thus, the removable jack face bezel allows for the non-disruptive change of jack usage designation as the communication circuit infrastructure migrates to new power usage.

In an example scenario, use of the removable jack face bezel (e.g., jack face bezel 224, 334, or a bezel with another profile) allows the communication circuit infrastructure to be initially installed with in-wall cabling (permanent links) that is certified for a specific power threshold (e.g., 15 W, 30 W, 60 W, 100 W, etc.). Initially, this system may not be initially utilized to deliver power at levels above the phantom voltage level. During this phase of usage, a jack face bezel 502 with a standard RJ45 jack profile (as shown in FIG. 5) may be installed on the jack receptacle housing 226, allowing traditional non-power certified patch cords, equipment cords, and the like to be utilized. This allows for reuse of existing products with full backward compatibility. During phase two of the system usage, one or more of the existing system permanent links may be transitioned to use as powered circuits (e.g., by the addition of power supplying equipment and one or more powered devices to the existing circuits). As these circuits would now require implementation of power certified patch and equipment cables (or other power rated components), a means to differentiate and control the use of these circuits becomes necessary. The changeable bezel system allows the jack face bezel 502 with standard profile to be removed and replaced with a new "powered circuit" bezel (e.g., jack face bezel 224, 324, or another bezel with a different keying feature) on the jack receptacle housing 226. The shape of the profile (and, in color-coded embodiments, the color of the bezel) visually distinguishes the jack receptacle 202 as being connected to a powered circuit. The new bezel prohibits a traditional non-power-certified plug from being mated with the jack receptacle 202.

Figure 6:
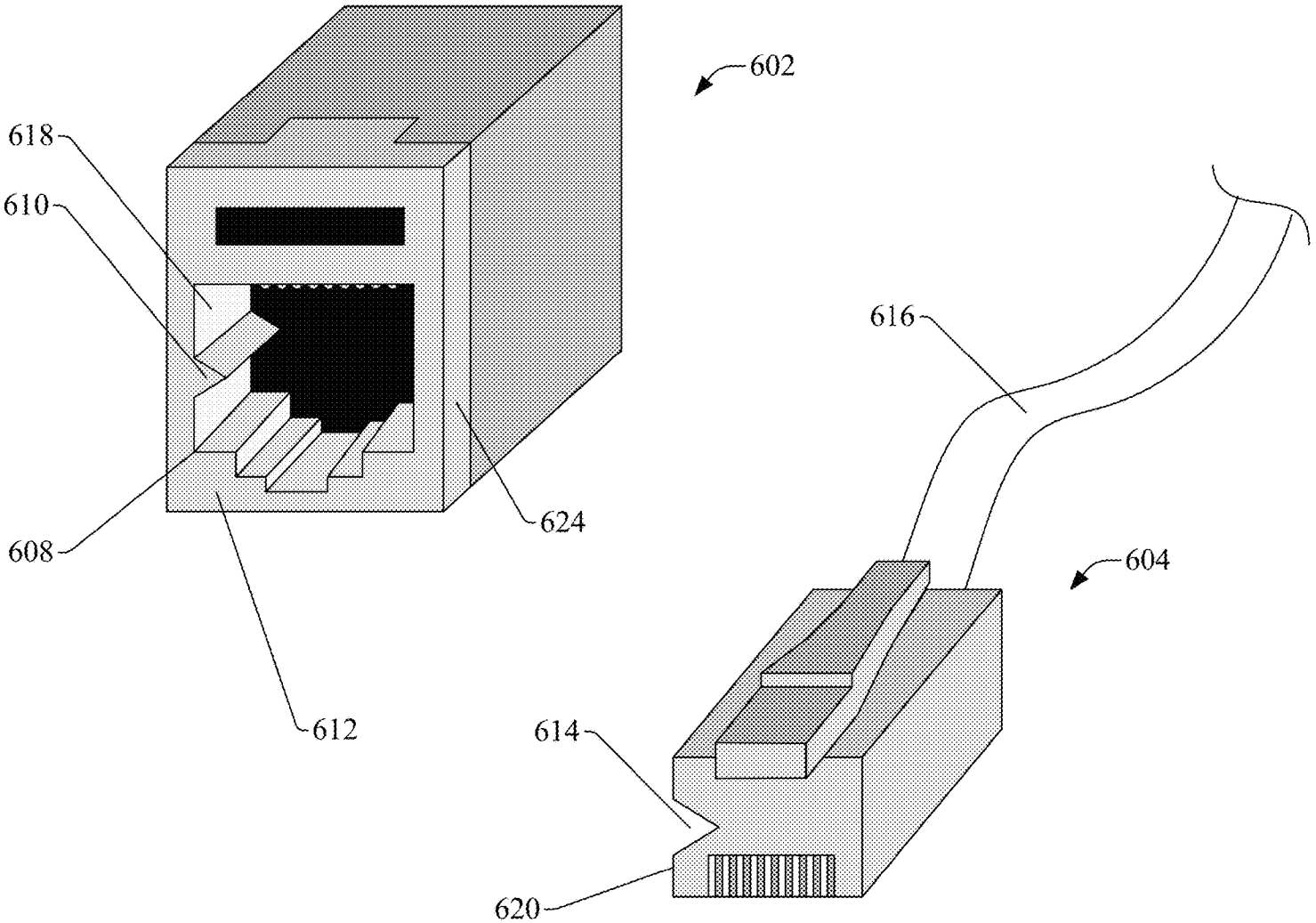
FIG. 6 is a three-dimensional view of an example RJ45 jack receptacle and corresponding plug connector having modified profiles that inverse the keying features depicted in FIG. 2.

In order to prevent non-power-certified plugs from being inserted into power-certified communication circuits, some embodiments of the modified jack-plug system can reverse the convex and concave nature of the profile modifications between the jack and the plug. FIG. 6 is a three-dimensional view of an example RJ45 jack receptacle 602 and corresponding plug connector 604 having a modified profile that inverses the keying features depicted in FIG. 2. That is, whereas FIG. 2 depicts the front opening 208 of the jack receptacle 202 as having concave V-shaped groove 210, while the plug connector 204 is configured with a corresponding convex V-shaped protrusion 214, the front opening 608 of jack face bezel 624 on jack receptacle 602 is configured with a convex V-shaped protrusion 610, while plug connector 604 is configured with a corresponding concave V-shaped groove 614 in sidewall 620. When jack face bezel 624 is used on a jack receptacle 602 that has been migrated to use as a powered communication circuit, these profile features prohibit traditional non-power certified plugs from mating with jack receptacle 602 by virtue of the convex V-shaped protrusion 610. Replacing a standard RJ45 jack face bezel 502 with this powered-circuit jack face bezel 624 effectively changes the profile of the jack receptacle 602, thereby requiring a corresponding power certified patch cable 616 to be outfitted with plug connector 604 to allow mating with the jack receptacle 602.

Modified powered-circuit bezels can be provided in a number of varieties, with each bezel aligned to a specific power threshold rating. Furthermore, in some embodiments the removable jack face bezels can employ a color-coding to further aid in identification of a powered circuit. Patch cords and other connecting cords can also utilize this color-coding scheme to simplify coordination of jacks and accessories certified and rated for specific power thresholds.

Figure 7:
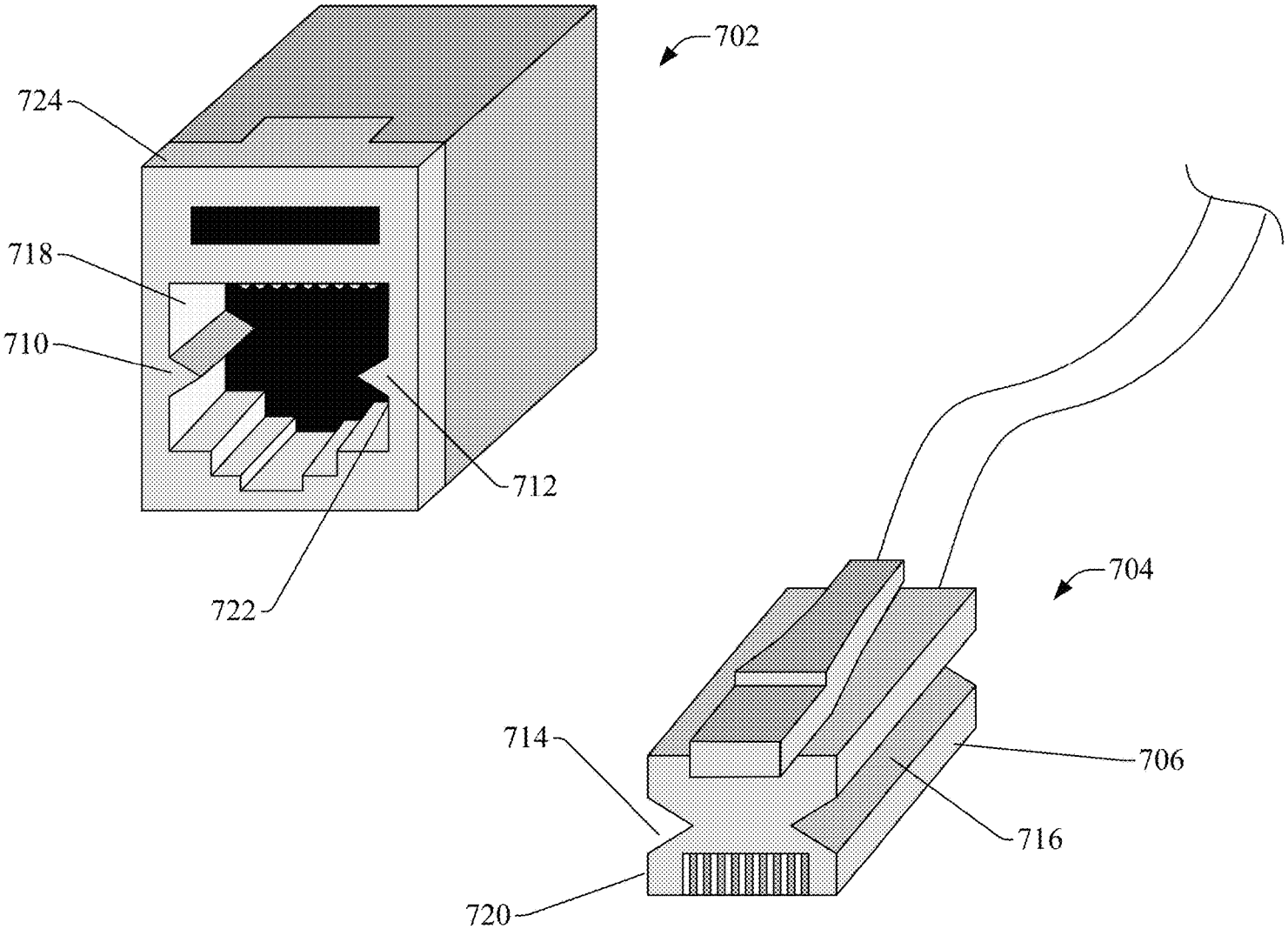
FIG. 7 is a three-dimensional view of an example RJ45 jack receptacle and corresponding plug connector having modified profiles that includes two V-shaped profile features on respective two opposing sides.
Figure 8:
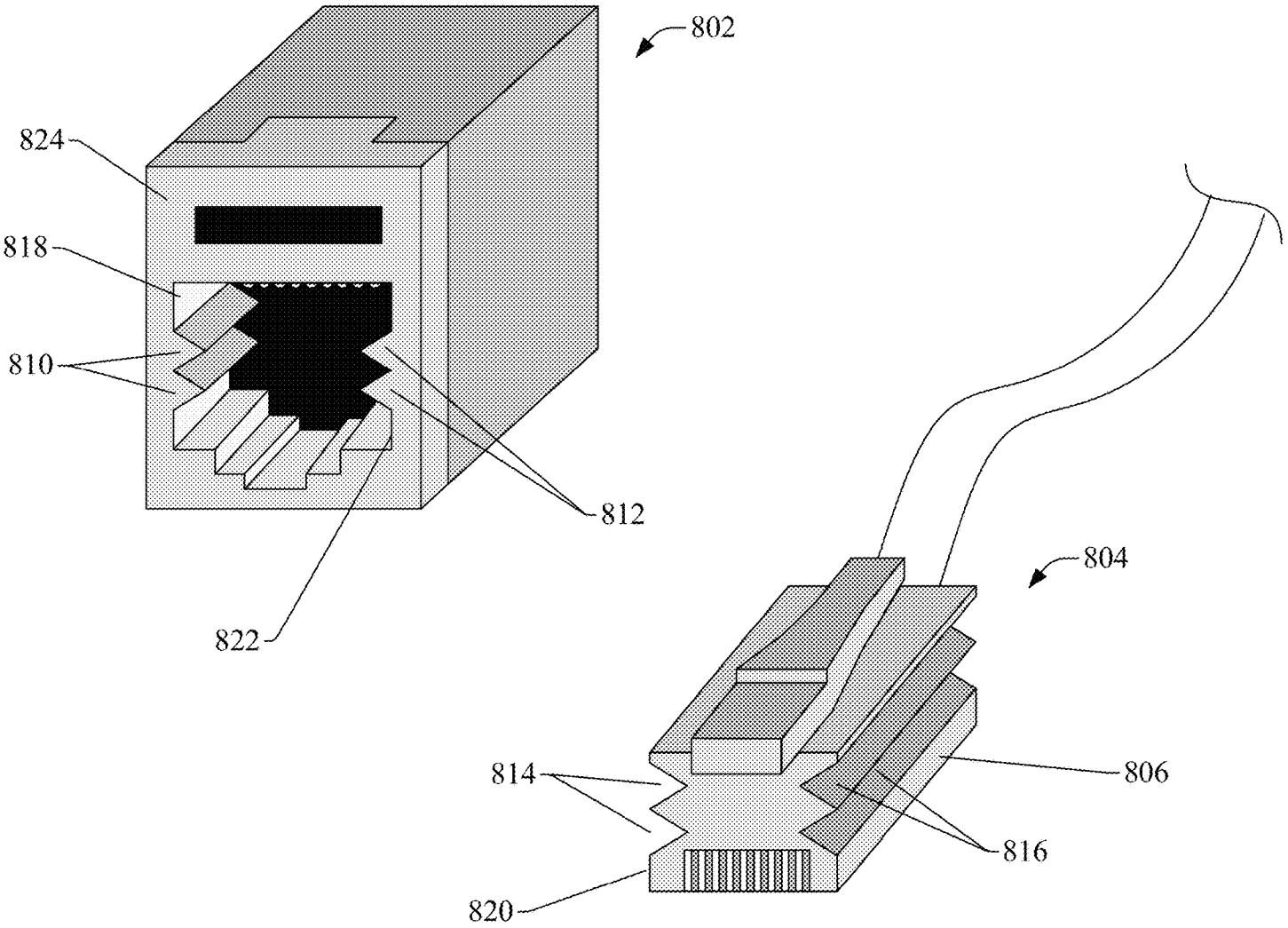
FIG. 8 is a three-dimensional view of an example RJ45 jack receptacle and corresponding plug connector having modified profiles that includes two V-shaped profile features on each of two opposing sides.
Figure 9:
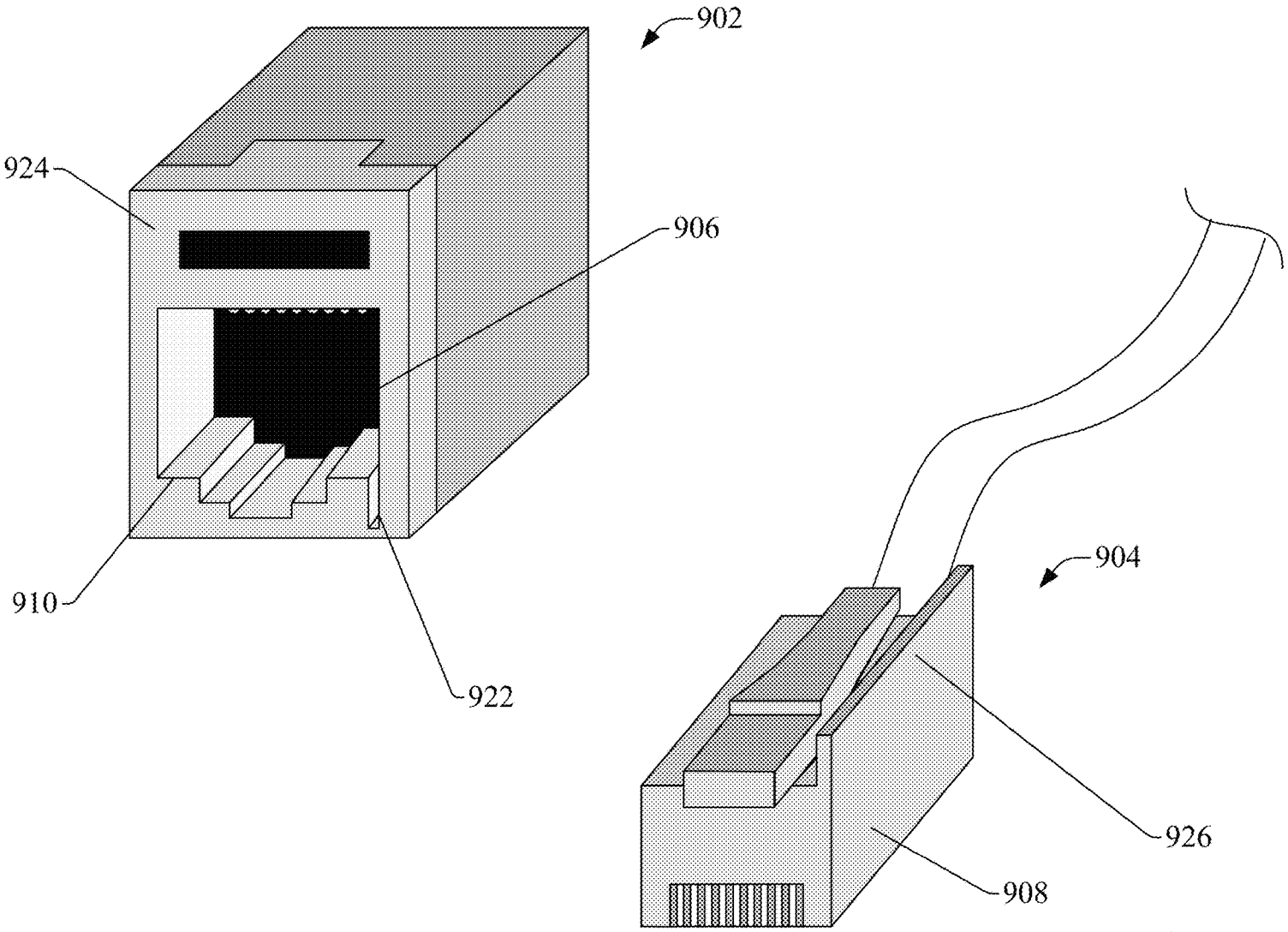
FIG. 9 is a three-dimensional view of an example RJ45 jack and corresponding plug connector having modified profiles that includes a straight keying feature.

FIGS. 7-9 depict other example jack and plug profiles that can be implemented using the removable bezels. FIG. 7 is a three-dimensional view of an example RJ45 jack receptacle 702 and corresponding plug connector 704 having a modified profile that includes two V-shaped profile features. In this example, removable bezel 724 on jack receptacle 702 includes two convex V-shaped protrusions 710 and 712 on opposing sidewalls 718 and 722, respectively, while plug connector 704 includes two corresponding concave V-shaped grooves 714 and 716 on opposing side surfaces 720 and 706, respectively. V-shaped grooves 714 and 716 of plug connector 704 are configured to receive corresponding V-shaped protrusions 710 and 712 of the jack face bezel 724 when the plug connector 704 is inserted into jack receptacle 702 via removable jack face bezel 724. FIG. 8 is a three-dimensional view of an example RJ45 jack receptacle 802 and corresponding plug connector 804 having a modified profile that includes two V-shaped keying features on opposing sides. In particular, bezel 824 includes two convex V-shaped protrusions 810 on a first sidewall 818, and two other convex V-shaped protrusions 812 on the opposing sidewall 822. Correspondingly, plug connector 804 is configured with two concave V-shaped grooves 814 on a first side surface 820, and another two concave V-shaped grooves 816 on the opposing second side surface 806. The V-shaped grooves 814 and 816 of plug 804 are configured to receive the corresponding V-shaped protrusions 810 and 812 of bezel 824 when plug connector 804 is inserted into jack receptacle 802.

FIG. 9 is a three-dimensional view of an example RJ45 jack receptacle 902 and corresponding plug connector 904 having a modified profile that uses a straight keying feature rather than a V-shaped keying feature. In this example, removable jack face bezel 924 of jack receptacle 902 has a front opening 910 with a profile that is substantially similar to a standard RJ45 profile, but which includes, as a keying feature, an indentation feature 922 in the lower right corner of the front opening 910. This indentation feature 922 is formed by extending one interior side wall 906 of the bezel downward, resulting in a narrow vertical groove located at the lower right corner of the front opening 910. Correspondingly, a side surface 908 of plug connector 904 is extended to form a slender protrusion 926 that extends from a corner of the plug connector 904. This protrusion 926 is configured to slot into corresponding indentation feature 922 of the jack face bezel 924 when the plug connector 904 is inserted into the jack receptacle 902.

It is to be appreciated that the modified profiles are not limited to the shapes illustrated and described herein. Rather, the removable jack face bezels and plug connectors can be configured with other profile shapes and/or keying features without departing from the scope of one or more embodiments of this disclosure.

The use of a removable or changeable bezel to physically change the jack interface can eliminate the need to re-terminate or change the permanent link installed in the wall or on a circuit board when an existing data-only circuit is converted to a power-certified communication circuit (or when a power rating of a circuit is changed). Instead, the user need only replace the removable bezel to that corresponding to the new certification and/or rating in order to ensure that the circuit is properly recognizable and that only properly rated accessories (e.g., patch cords, devices, etc.) can be plugged into the jack. This system can also afford protection from overvoltage events such as fire or shock by prohibiting the use of non-certified products within a powered communication circuit. The modified jack and bezel system can also facilitate cost effective and safe migration of a circuit infrastructure, extending product lifecycle and providing a beneficial return on investment.

The ability to create an end-to-end system that is certified and tested to a specific power threshold is imperative to the proper working and safety of the circuits. The modified jack and plug systems described herein allows the creation of such an environment while also simplifying inspection by the Authority Having Jurisdiction (AHJ) during the inspection phase of installation and issuance of documents such as a building Certificate of Occupancy (CO). Moreover, the modified jack and plug systems described herein allows for the installation of forward looking infrastructure while maintaining the ability to utilize common non-specialized components such as patch cords when the circuit is used in a traditional non-powered data communication manner. Also, the modified jack and plug systems described herein can create a control point within the infrastructure to allow administration of a process to assure proper circuit power usage.

As noted above, although the example set forth herein have been described in terms of modified RJ45 jacks and plugs, it is to be appreciated that the techniques described herein are suitable for use with other types of data jacks and ports, including but limited to GigaGate 45 (GG45), Augmented Registered Jack 45 (ARJ45) or other ARJ systems, TERA, or other such connector types.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

What has been described above includes examples of systems and methods illustrative of the disclosed subject matter. It is, of course, not possible to describe every combination of components or methodologies here. One of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A connector jack receptacle, comprising:

a bezel that attaches to a front side of a jack receptacle housing, wherein the bezel comprises an opening having a first keying feature, the first keying feature comprises an indentation formed by extending an interior side wall of the bezel downward at a corner of the bezel yielding a vertical groove at the corner, and the first keying feature allows a first plug connector having a corresponding second keying feature to be inserted into the opening, and allows a second plug connector without the corresponding second keying feature to be inserted into the opening.

2. The connector jack receptacle of claim 1, wherein the second keying feature comprises a protrusion corresponding to the indentation.

3. The connector jack receptacle of claim 1, wherein the second plug connector is at least one of a registered jack 45 (RJ45) connector, a GigaGate 45 (GG45) connector, an augmented registered jack 45 (ARJ45) connector, or a TERA connector.

4. The connector jack receptacle of claim 1, wherein the connector jack receptacle and the first plug connector conform to a defined power threshold rating.

5. The connector jack receptacle of claim 4, wherein a color of the bezel corresponds to the defined power threshold rating.

6. The connector jack receptacle of claim 5, wherein the color is a first color, and a second color of the first plug connector matches the first color.

7. The connector jack receptacle of claim 4, wherein a position of the first keying feature on the bezel corresponds to the defined power threshold rating.

8. The connector jack receptacle of claim 4, wherein the opening comprises multiple keying features, including the first keying feature, and a number of the multiple keying features corresponds to the defined power threshold rating.

9. The connector jack receptacle of claim 1, wherein the jack receptacle housing comprises insulation displacement connector terminals electrically connected to the array of signal contacts.

10. A connector jack receptacle, comprising:

an opening formed on a bezel attached to a front side of the connector jack receptacle;

wherein the opening comprises a groove formed by extending an interior side wall of the bezel downward at a corner of the bezel, and the groove permits a first plug connector with a corresponding protrusion to be inserted into the opening, and permits a second plug connector without the corresponding second keying feature to be inserted into the front opening.

11. The connector jack receptacle of claim 10, wherein the protrusion is formed on a corner of the first plug connector.

12. The connector jack receptacle of claim 10, wherein the second plug connector is at least one of a registered jack 45 (RJ45) connector, a GigaGate 45 (GG45) connector, an augmented registered jack 45 (ARJ45) connector, or a TERA connector.

13. The connector jack receptacle of claim 10, further comprising a jack receptacle housing; and an array of signal contacts located inside the jack receptacle housing, wherein the bezel attaches to the jack receptacle housing.

14. The connector jack receptacle of claim 10, wherein the connector jack receptacle and the first plug connector are rated to a defined power threshold.

15. The connector jack receptacle of claim 14, wherein a color of the bezel corresponds to the defined power threshold.

16. The connector jack receptacle of claim 15, wherein the color is a first color, and a second color of the first plug connector matches the first color.

17. The connector jack receptacle of claim 14, wherein a location of the groove on the bezel corresponds to the defined power threshold.

18. The connector jack receptacle of claim 14, wherein the front opening comprises multiple keying features, including the vertical groove, and a number of the multiple keying features corresponds to the defined power threshold.

19. A plug connector, comprising:

a first keying feature comprising a protrusion formed on a first corner of the plug connector, wherein the protrusion corresponds to a second keying feature formed on an opening of a bezel attached to a jack receptacle, the second keying feature comprises an indentation feature formed by extending an interior side wall of the bezel downward at a second corner of the bezel yielding a vertical groove at the second corner, and the protrusion is configured to slot into the indentation feature of the bezel while the plug connector is inserted into the jack receptacle.

20. The plug connector of claim 19, wherein the plug connector and the jack receptacle are rated to a defined power threshold, and the plug connector and the jack receptacle comprise matching colors indicative of the defined power threshold.

* * * * *